United States Patent [19]

Fanson

[11] Patent Number: 4,754,622

[45] Date of Patent: Jul. 5, 1988

[54] WATER INLET DEVICE FOR AUTOMATIC WASHER

[75] Inventor: Richard L. Fanson, St. Joseph Township, Berrien County, Mich.

[73] Assignee: Whirlpool Corporation, Benton Harbor, Mich.

[21] Appl. No.: 865,679

[22] Filed: May 22, 1986

[51] Int. Cl.[4] ..... D06F 39/08

[52] U.S. Cl. ..... 68/207; 239/523; 239/590; 239/590.5

[58] Field of Search ..... 68/23.5, 207; 137/561 A; 239/521, 523, 590, 590.5

[56] References Cited

U.S. PATENT DOCUMENTS

| | | | |
|---|---|---|---|
| 2,552,398 | 5/1951 | Briggs | 68/207 X |
| 2,638,112 | 5/1953 | Shelton | 68/207 X |
| 2,921,488 | 1/1960 | Davis | 239/523 X |
| 3,020,741 | 2/1962 | Waldrop | 68/207 X |
| 3,081,041 | 3/1963 | Showalter | 239/523 X |
| 3,121,317 | 2/1964 | Toma | 68/23.5 |
| 3,304,751 | 2/1967 | Schwing | 68/23.5 |
| 3,466,902 | 9/1969 | Akers | 68/207 |
| 3,566,906 | 3/1971 | Beare | 68/207 X |
| 3,605,455 | 9/1971 | Olthuis | 68/207 |
| 4,000,968 | 1/1977 | Schrage et al. | 8/158 |
| 4,303,406 | 12/1981 | Ross | 8/158 |

*Primary Examiner*—Philip R. Coe

*Attorney, Agent, or Firm*—Hill, Van Santen, Steadman & Simpson

[57] ABSTRACT

A water inlet device for an automatic clothes washer is provided which provides a flow of water against an interior surface of a wash basket and onto a clothes load within the basket through a wide range of inlet water pressures while preventing excessive splashing against the basket wall at high water pressures. The inlet device has a downwardly angled front wall which redirects the inlet water into the wash basket, and the wall has a varying downward angle along its length to provide the automatic pressure compensation. A central portion of the lip is angled downwardly toward the basket wall and the lateral edges are angled downwardly away from the basket wall such that at normal water pressures most of the inlet water is directed at the central portion, and thus toward the basket wall, and at higher pressures more water is directed toward the lateral edges which direct the excess water away from the basket wall and directly onto the clothes load.

10 Claims, 2 Drawing Sheets

WATER INLET DEVICE FOR AUTOMATIC WASHER

BACKGROUND OF THE INVENTION

1. Field of the Invention

The present invention relates to a water inlet device for an automatic washer and more particularly to a water inlet device which provides basket side wall washing and uniform clothes load rinsing while compensating for varying water inlet pressures.

2. Description of the Prior Art

Water inlet devices are used to provide a vacuum break in the inlet line and to dispense water from an inlet conduit into the basket of a washing machine onto a clothes load which is located in the bottom of the basket. Various configurations of water inlets have been proposed for providing an inlet water flow directed toward various portions of the interior of the wash basket including the basket wall, directly upon the clothes or directed toward the agitator.

For example, U.S. Pat. No. 4,00,968 discloses an inlet device which directs incoming wash fluid toward the central vertical agitator which then causes a redirected spray onto the clothes. U.S. Pat. No. 3,304,751 discloses an inlet device having two separate outlet openings, one directing spray toward the agitator and a second directing spray toward the basket wall. U.S. Pat. No. 4,303,406 discloses various inlet arrangements for dispensing water throughout a range of locations within the basket.

While it is desirable to have the inlet water spray uniformly on the clothes within the basket, it is also desirable to spray against the interior basket wall to rinse collected soap, dirt and other particles from the wall during the rinse cycle to remove that material so that it is not redeposited on the clothes load. Further, it is important to not have an excessive amount of spraying against the interior wall of the basket at high pressures since this causes redirected spray throughout the interior of the basket including up into the basket opening area and into areas of the washer cabinet which are not designed for excessive water spray.

Thus a problem develops in the use of inlet devices regarding the compensation for varying water pressures from location to location geographically and for various water pressures at a given location so that a uniform spray of water is directed toward the interior of the basket and on the clothes without excessive spray being directed against the basket wall.

At least one prior patent, U.S. Pat. No. 3,605,455 discloses a water inlet that is designed to provide a gentle stream of incoming water regardless of wide variations in inlet water pressure. That device uses a plurality of downwardly depending fingers or projections 63 to break up the water flow and as the water pressure increases, the water will come into contact with a greater number of projections. Although with respect to FIGS. 6 and 7 it is stated that due to the upwardly arched nature of the portion 62, the stream is caused to discharge at a predetermined trajectory somewhat inclined from the vertical (without disclosing what the inclination is), it is stated that the discharge trajectory will remain substantially constant. The device disclosed in that patent does not appear to provide for a rinsing of the interior side wall of the basket.

SUMMARY OF THE INVENTION

The purpose of the present invention is to provide a water inlet device which delivers water to the proper portion of the wash basket during fill operations regardless of the household water pressure. In particular, the device is intended to correct problems with prior devices which created excessive rearward spray under high water inlet pressures, resulting in some water splashing onto or over the tub ring.

The present invention provides a water inlet device which directs a portion of an inlet water stream against the interior wall of the wash basket regardless of the water pressure of the inlet stream, and directs excess incoming water downwardly to prevent excessive undesirable splashing under high pressure conditions.

The inlet device is mounted to the rear wall of the cabinet and extends over the tub ring to deliver water into the basket. To provide the water pressure compensating feature, the inlet device has a front lip or wall positioned over the interior of the basket and extending downwardly from a top wall portion of the device against which all of the inlet water is directed. The lip has a varying cross-sectional configuration in that a central portion of the lip in line with an inlet water nozzle has an interior wall which is directed downwardly and off-vertical toward the basket wall. To either lateral side of the center of the lip the downward angle of the wall changes, first moving toward a vertical orientation and then toward an off-vertical orientation away from the basket wall, toward the center of the basket. Incoming water is directed against the downwardly sloping front wall of the device by an inlet nozzle. The inlet nozzle is positioned so that the water impinges upon the top wall at a point somewhat downstream from the end of the nozzle. As the water stream impinges upon the top wall, it tends to spread as it proceeds toward the front lip portion of the device, from which the water is discharged into the basket. The device delivers the water to the spray in a downwardly directed loose stream which tends to spread or fan out slightly as it drops. As noted above, it is desirable that some of the stream be directed slightly rearwardly so as to wash soap deposits, etc., from the basket sidewall during spin rinse operations. It is, of course, also desirable that the clothes load being spun within the basket be uniformly wetted by the incoming water during spray rinses.

Thus, during low water pressure conditions, most of the inlet water will be directed toward the center of the lip and will be deflected downwardly and toward the wash basket wall with a portion of the inlet water flowing to either side of the center portion of the lip and being directed toward progressively lower portions of the basket wall and downwardly on to the clothes load. As the water pressure increases, more and more of the inlet water will be directed at portions of the lip laterally further away from the center portion of the lip and thus will be directed in greater amounts lower on the basket interior wall or away from the basket wall, such that at very high inlet water pressures most of the water will be directed downwardly onto the clothes load which will prevent excessive splashing, while the relatively constant amount of water will be directed against the basket interior wall for rinsing purposes.

Thus, the present invention provides a water inlet device which provides a uniform flow of rinse water against the interior of the tub basket at all water pressures and also prevents excessive splashing of incoming water against the basket wall at higher pressures while providing for wetting of the clothes load in the basket at all water pressures.

DESCRIPTION OF THE PREFERRED EMBODIMENTS

Figure 1:
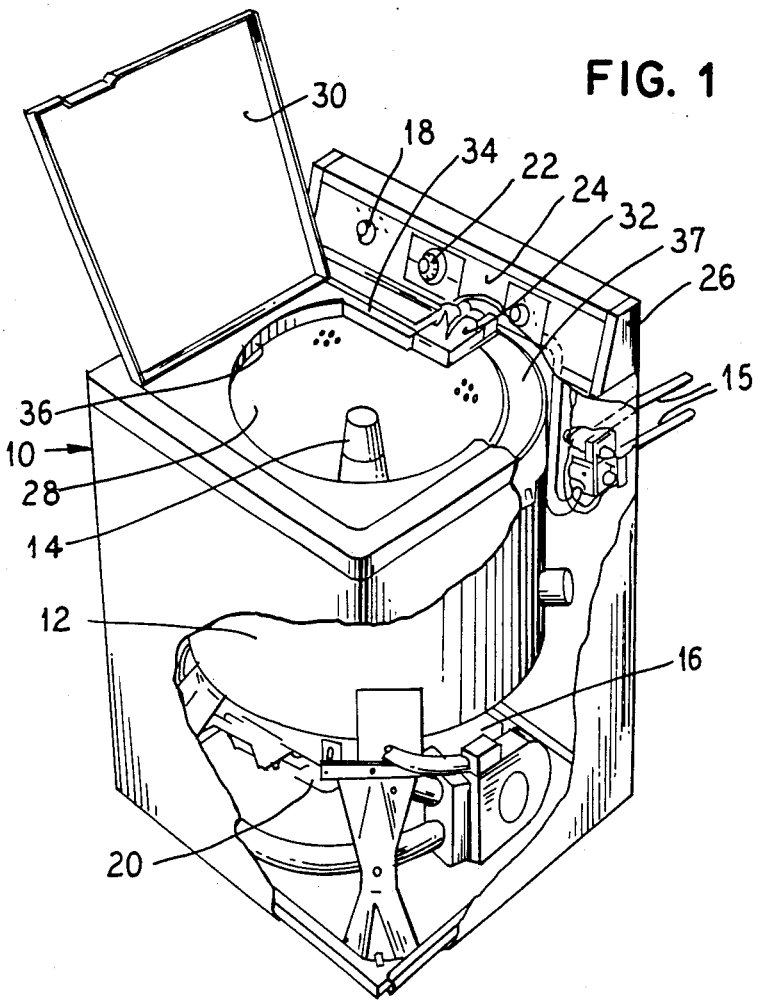
FIG. 1 is a perspective view of an automatic washer with an inlet device embodying the principles of the present invention.

In FIG. 1 a washing machine is generally shown at 10 which has a tub 12 with a vertical agitator 14 therein, a water supply 15, a power supply (not shown), an electrically driven motor 16 operably connected via a transmission 20 to the agitator 14, and controls 18 including a pre-settable sequential control means 22 for use in selectively operating the washing machine 10 through a programmed sequence of washing, rinsing and extracting steps. The control means 22 is mounted to a panel 24 of a console 26 on the washing machine 10. A rotatable and perforate basket 28 is carried within the tub 12 and is accessible through an openable top lid 30 of the washer 10.

A water inlet device 32 embodying the principles of the present invention is mounted beneath a panel 34 forming a portion of the washer cabinet which includes an opening 36 into the interior of the wash basket 28. The inlet device 32 is conveniently mounted beneath the console 26 and extends over a tub ring 37 so that a portion of the inlet device is positioned above the basket.

Figure 2:
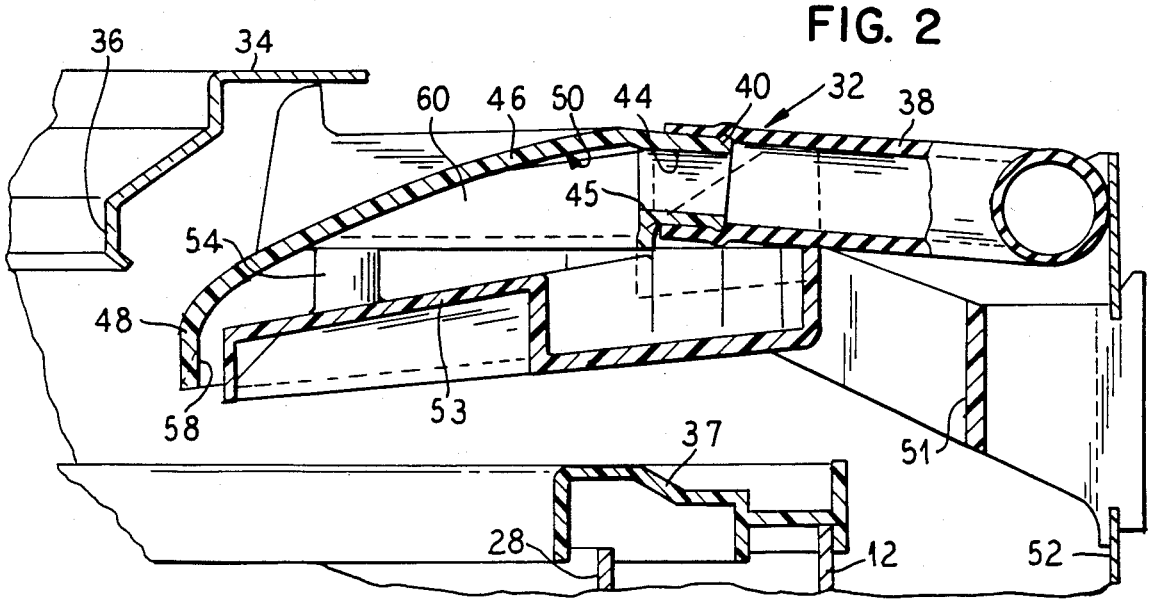
FIG. 2 is a side sectional view of an inlet device of the present invention taken generally along the lines II—II of FIG. 3.
Figure 3:
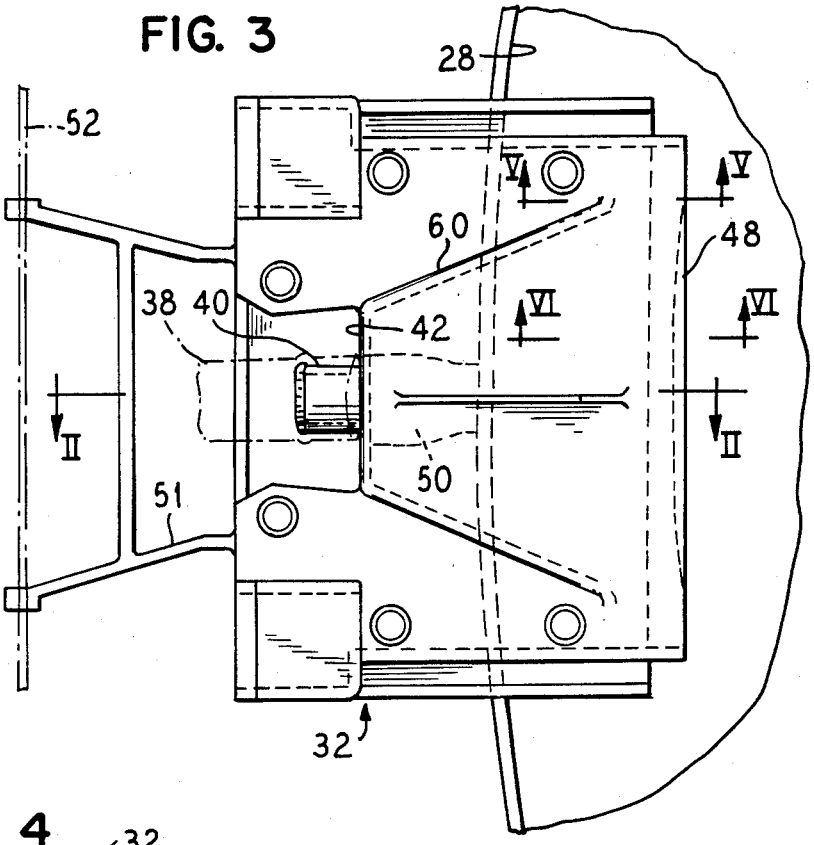
FIG. 3 is a plan view of the inlet device.

The water inlet device 32 is shown in greater detail in FIGS. 2–7. FIG. 2 is a side sectional view of the water inlet device 32. A water inlet conduit 38 attaches to a cylindrical inlet nozzle 40. Referring also to FIG. 3, the inlet nozzle 40 projects from a rear wall 42 of the inlet device and a central passage 44 through the cylindrical portion 40 communicates at an opening 45 with an interior of the inlet device slightly below a top wall 46. The top wall 46 curves downwardly away from the inlet nozzle 44 and terminates at a front downwardly disposed wall or lip 48. A depressed area 50 is formed in the upper wall 46 adjacent the communicating opening 45 of the passage 44 to provide a channeling effect for water entering the inlet device and to direct the incoming flow of water toward a central portion of the lip 48.

The inlet device 32 is attached to a mounting bracket 51 which is in turn secured to a rear wall 52 of the washer cabinet. The mounting bracket 51 includes a floor portion 53 of the inlet device and the top portion of the inlet device is secured to the bracket by appropriate fastening means such as screws and is held in a spaced apart relationship with the floor portion 53 by means of spacers 54.

Figure 5:
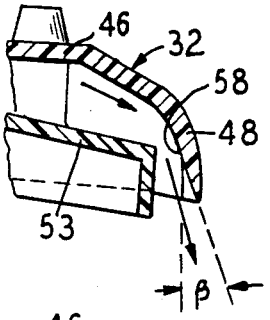
FIG. 5 is a partial side sectional view of the inlet device taken generally along the lines V—V of FIG. 3.
Figure 6:
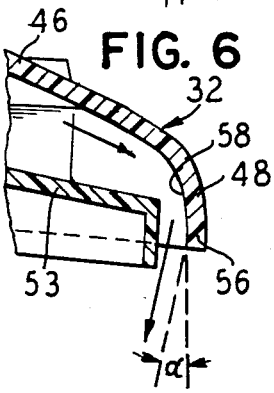
FIG. 6 is a partial side sectional view of the inlet device taken generally along the lines VI—VI of FIG. 3.
Figure 4:
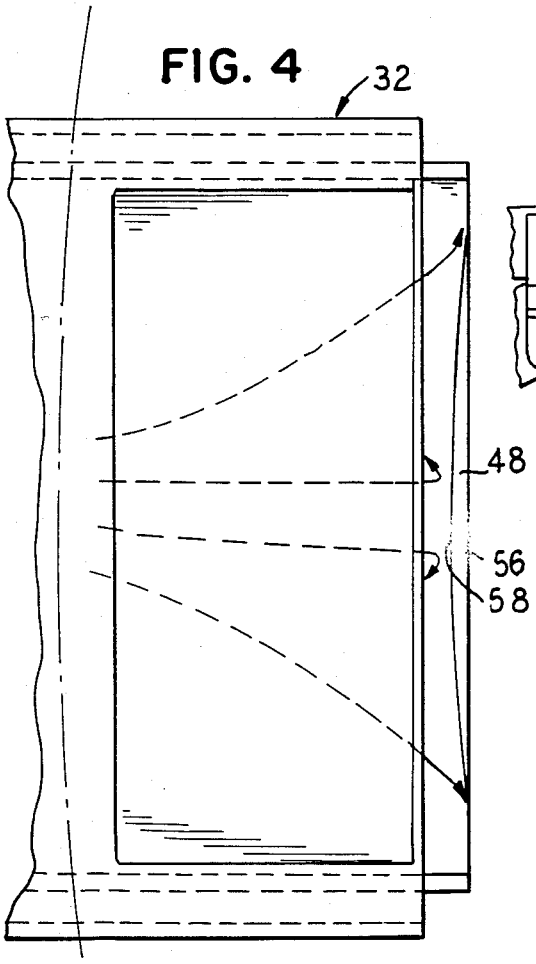
FIG. 4 is a bottom view of the inlet device.

As seen in FIGS. 4–6, the lip 48 has a varying configuration along the front lateral expanse of the water inlet device. A center portion 56 as seen in FIGS. 4 and 6 is relatively thick and is arranged such that when the water inlet device is mounted within the washing machine 10 by means of the mounting bracket 51, an interior surface 58 of the lip 48 terminates at an angle $\alpha$ away from vertical so as to direct water flowing along the interior surface at that point toward the basket 28. To either lateral side of the central portion 52 of the lip 48, the thickness of the lip tapers and the angle of the interior wall 58 changes, passing through vertical to an angle $\beta$ near an outside edge of either side of the inlet device 32. The wall at angle $\beta$ is directed downwardly and slightly toward the agitator. It has been found that an inlet device constructed such that angle $\alpha$ is 13° and angle $\beta$ is 15° provides a uniform rinsing of the basket wall and spraying of the clothes load in the washer throughout a range of water pressures within the range of 20–70 lbs. per sq. inch.

Figure 7:
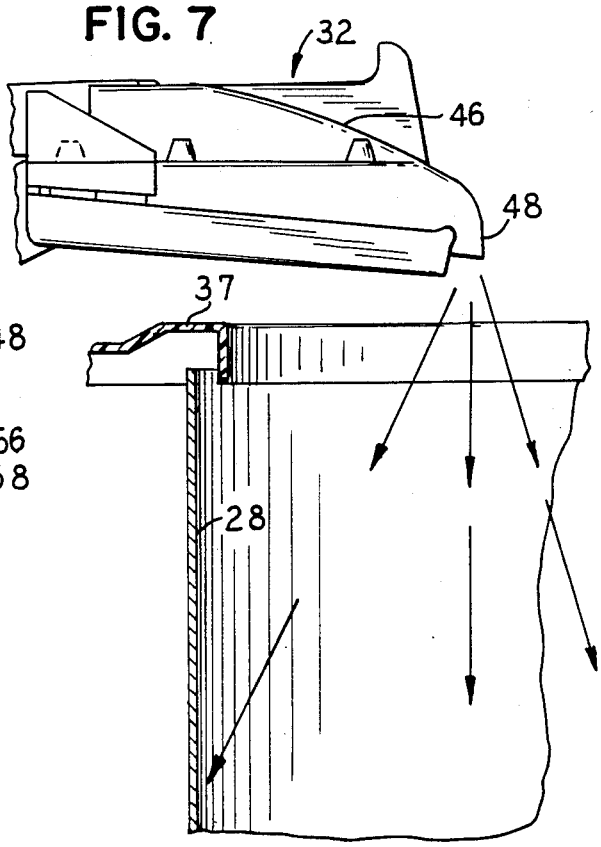
FIG. 7 is a schematic illustration of the water inlet device in operation.

In operation, since the opening 45 of the inlet nozzle is spaced slightly away from the top wall 46, the inlet water is prevented from spreading away from the center line by an amount greater than is desirable. As the incoming water stream impinges upon the top wall, it tends to spread as it proceeds toward the front lip 48, from which the water is discharged into the basket. The depressed area 50 as well as larger channel side walls 60 help to keep the flow of incoming water directed principally toward the center portion of the lip 48 at low inlet water pressures thus causing a desired amount of water to be directed toward the basket 28 to rinse collected soap, dirt and other particles from the wall so that it is not redeposited on the clothes load. When water is being delivered under high pressure, the increased pressure and thus increased volume of water causes a substantial amount of the flow to spread outwardly to the laterally spaced portions of the lip. This spread out water flow is directed downwardly on to the clothes load within the basket, as illustrated in FIG. 7, instead of against the basket sidewall. Thus, by providing the contour to the front lip 48, the device automatically compensates for varying inlet water pressures and prevents excessive and unwanted splashing against the side wall of the basket at high water pressures, although it continues to provide the certain desired amount of water flow to rinse the basket wall at all water pressures.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

The embodiments of the invention in which an exclusive property privilege is claimed are defined as follows:

1. In an automatic washer having a vertical axis agitator mounted within a wash basket, a water inlet device comprising:

a water inlet nozzle projecting through a rear wall of said water inlet device;

a top wall joined to said rear wall and having a downward slope away from said inlet nozzle;

a front lip on said top wall;

said front lip being angled downwardly to direct inlet water downwardly into said wash basket;

the downward angle of said front lip varying along the width of said inlet device with a portion being angled downward and slightly rearward and a portion being angled downward and slightly forward such that inlet water is directed to various locations within said basket by said lip.

2. A water inlet device according to claim 1, wherein said water inlet nozzle is spaced below said top wall to direct the inlet water against said top wall at a point somewhat downstream of said rear wall.

3. A water inlet device according to claim 1, wherein said water inlet nozzle is positioned centrally in said rear wall to direct the primary portion of the incoming water toward a central portion of said lip under normal inlet water pressure conditions.

4. In an automatic washer having a vertical axis agitator mounted within a wash basket, a water inlet device comprising:

a water inlet nozzle projecting through a rear wall of said water inlet device;

a top wall joined to said rear wall and having a downward slope away from said inlet nozzle;

a front lip on said top wall;

said front lip being angled downwardly to direct inlet water downwardly into said wash basket;

the downward angle of said front lip varying along the width of said inlet device wherein a central lip portion is angled downward and slightly rearward and laterally spaced ends of said lip are angled downward and slightly forward with the angle of the lip gradually changing between the central portion and the spaced ends, such that inlet water is directed to various locations within said basket by said lip.

5. A water inlet device according to claim 1, wherein said top wall has a channel-like depressed area formed therein downstream of said inlet nozzle to direct a portion of the inlet water toward a central portion of said lip.

6. In an automatic clothes washer having an outer cabinet surrounding a wash tub with a concentrically mounted wash basket within the wash tub for carrying a clothes load and a vertical axis agitator within the wash basket, a water inlet device comprising:

a mounting member having one end attached to said washer cabinet and a second end forming a bottom portion of said inlet device;

a rear wall and joined top wall secured to said mounting member;

a centrally disposed water inlet nozzle projecting through said rear wall and being spaced downwardly away from said top wall;

said top wall sloping downwardly away from said inlet nozzle and having a downwardly angled front lip;

said front lip being positioned over said basket and having a central portion angled downwardly and slightly rearwardly toward said basket and laterally spaced ends angled downwardly and slightly forwardly toward said agitator;

whereby inlet water will be directed by said nozzle toward said central portion of said lip at normal water inlet pressures to flow downwardly against said basket and onto said clothes load while at higher water inlet pressures more water will flow toward said lateral ends of said lip to be diverted directly downwardly onto said clothes load within said basket.

7. A water inlet device according to claim 6, wherein said top wall has a channel-like depressed area formed therein downstream of said inlet nozzle to direct a portion of the inlet water toward a central portion of said lip.

8. An inlet water device for use with an automatic washer comprising:

an inlet nozzle projecting through a rear wall of said device;

a top wall joined to said rear wall and sloping downwardly away from said inlet nozzle;

said top wall having a downwardly directed front lip with a central portion opposite said inlet nozzle to redirect the flow of water from said inlet nozzle;

said front lip having a varying downward angle along the lateral length thereof with said central portion being angled downwardly and rearwardly and lateral edges being angled downwardly and forwardly such that said nozzle directs the primary portion of the incoming water toward said central portion of said lip at normal water inlet pressures and increasing amounts of incoming water are directed at the lateral edges of said lip at higher water pressures.

9. A water inlet device according to claim 8, wherein said water inlet nozzle is spaced below said top wall to direct the inlet water against said top wall at a point somewhat downstream of said rear wall.

10. A water inlet device according to claim 8, wherein said top wall has a channel-like depressed area formed therein downstream of said inlet nozzle to direct a portion of the inlet water toward a central portion of said lip.

* * * * *